US007671810B2

(12) United States Patent
Yu

(10) Patent No.: US 7,671,810 B2
(45) Date of Patent: Mar. 2, 2010

(54) ANTENNA STRUCTURE FOR A NOTEBOOK

(75) Inventor: Yao-Wen Yu, Pa-Te (TW)

(73) Assignee: Auden Techno Corp., Pa-Te, Tao-Yuan Hsien (TW)

( * ) Notice: Subject to any disclaimer, the term of this patent is extended or adjusted under 35 U.S.C. 154(b) by 456 days.

(21) Appl. No.: 11/746,678

(22) Filed: May 10, 2007

(65) Prior Publication Data

US 2008/0278401 A1 Nov. 13, 2008

(51) Int. Cl.
*H01Q 1/24* (2006.01)
*H01Q 1/12* (2006.01)

(52) U.S. Cl. ..... 343/702; 343/878

(58) Field of Classification Search ..... 343/702, 343/878, 893
See application file for complete search history.

(56) References Cited

U.S. PATENT DOCUMENTS 7,034,762 B2 * 4/2006 Huang ..... 343/767
7,289,071 B2 * 10/2007 Hung et al. ..... 343/702
7,525,490 B2 * 4/2009 Hung et al. ..... 343/702
2004/0090378 A1 * 5/2004 Dai et al. ..... 343/700 MS
2004/0160370 A1 * 8/2004 Ghosh et al. ..... 343/702
2007/0060222 A1 3/2007 Finn
2008/0094303 A1 * 4/2008 Tseng et al. ..... 343/848

* cited by examiner

*Primary Examiner*—Shih-Chao Chen
(74) *Attorney, Agent, or Firm*—Guice Patents PLLC

(57) ABSTRACT

An antenna structure for a notebook with four radiation members, the antenna structure has an elongate supporting rack having thereon a first radiation member, a second radiation member, a third radiation member and a fourth radiation member; each radiation member is planar, and is integrally connected with the supporting rack. Thereby, when the notebook uses a plurality of antennas, the costs of mold developing and time for processing can be reduced, and in designing, the space of the antenna will not waste by having the structure, and a better effect in function can be obtained.

6 Claims, 4 Drawing Sheets

ANTENNA STRUCTURE FOR A NOTEBOOK

BACKGROUND OF THE INVENTION

1. Field of the Invention

The present invention relates to an antenna structure, and especially to an antenna structure which suits a notebook applied to multi-frequency wireless communication.

2. Description of the Prior Art

In fast progression of the technique of wireless communication, such as wireless local area network (LAN), gradually, mobile communication systems have been built in notebooks; thereby the notebooks can still be connected with the outside for transmitting data via the mobile communication systems. The working frequencies of the technique of wireless communication have developed to multi-frequencies very early before, such as VIFI, GSM 900, GSM 1800, DCS, CDMA and WCDMA etc.

In an U.S. patent application Ser. No. 2007/0060222 titled "Combination Antenna with Multiple Feed Points", there is a kind of combination antenna having therein a common structure for connecting a first electromagnetic radiation element and a second electromagnetic radiation element, the two electromagnetic radiation elements are provided for operating different frequency bands. The common structure includes a common antenna structure, a common mounting structure and a common grounding structure, in order that the space occupied by the first and the second electromagnetic radiation elements which are mounted separately can be saved.

The evidently not able to satisfy the requirement of mobile communication. And more, by virtue of the tendency of compacting of notebooks, the space for mounting hidden antenna becomes smaller and smaller; it is the main category of discussion of the present invention—how to design an antenna structure that can be applied to multiple frequency bands.

SUMMARY OF THE INVENTION

The present invention mainly is to provide an antenna structure for a notebook with four radiation members, the antenna structure has an elongate supporting rack having thereon a first radiation member, a second radiation member, a third radiation member and a fourth radiation member; each radiation member is planar, and is integrally connected with the supporting rack. Thereby, under space allowance of the notebook, for instance, above the screen, it is capable to mount a multi-frequency antenna structure at one time in a space saving mode; and this can make saving of cost and processing.

In the antenna structure provided for the present invention, at least two of the first to the fourth radiation members are of same working frequency, for instance, the frequencies of the first and the fourth radiation members are same, or the frequencies of the second and the third radiation members are same, but alternatively, they can be all different.

The antenna structure of the present invention not only can save the costs of mold developing and time for processing, but also can save space occupied in comparison with that having four radiation members mounted separately, the space of the antenna will not waste by having the structure, and a better effect in function can be obtained.

The present invention will be apparent in its structure and operational function after reading the detailed description of the preferred embodiment thereof in reference to the accompanying drawings.

DETAILED DESCRIPTION OF THE PREFERRED EMBODIMENT

Figure 1:
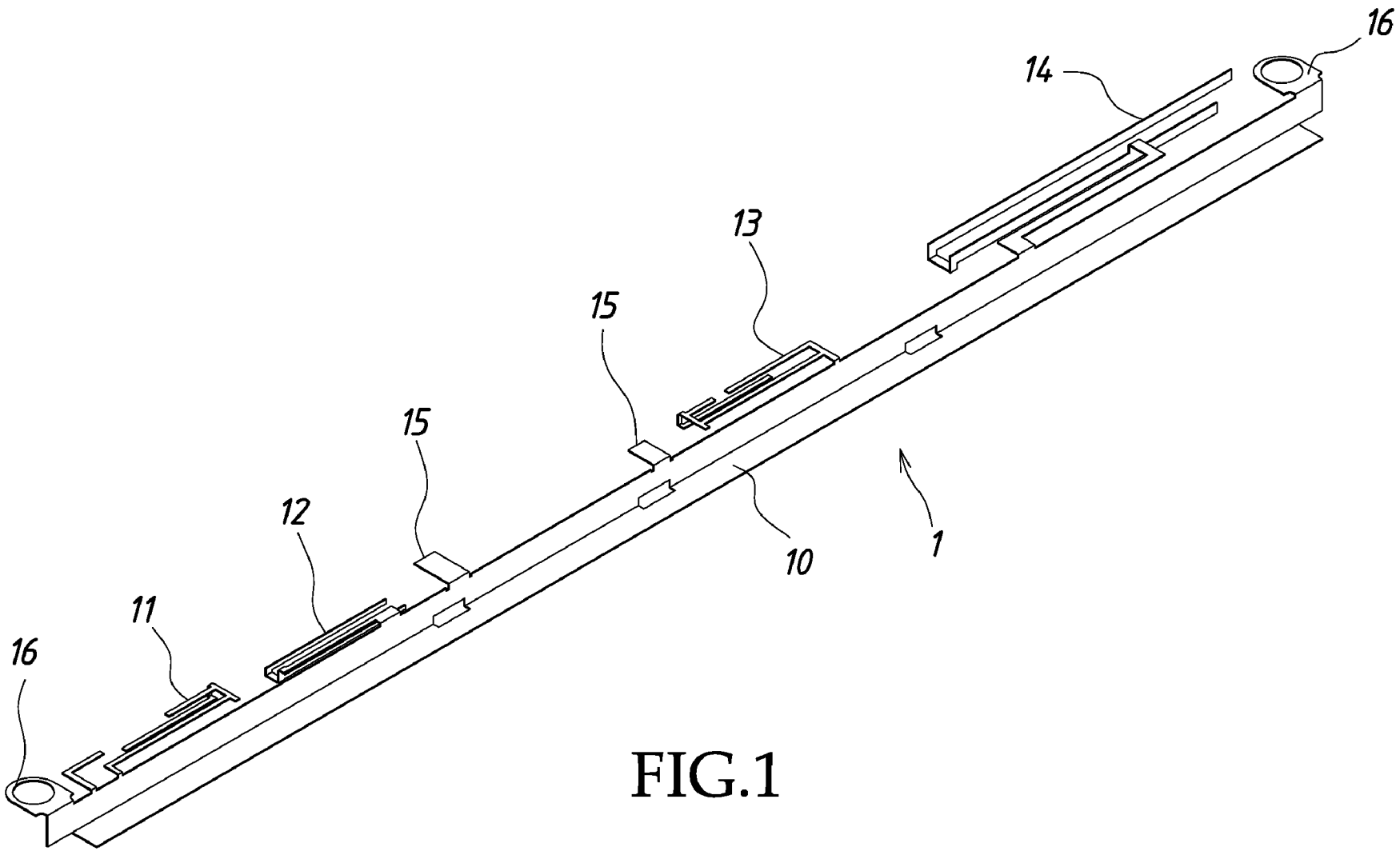
FIG. 1 is a perspective view showing the appearance of the present invention.
Figure 2:
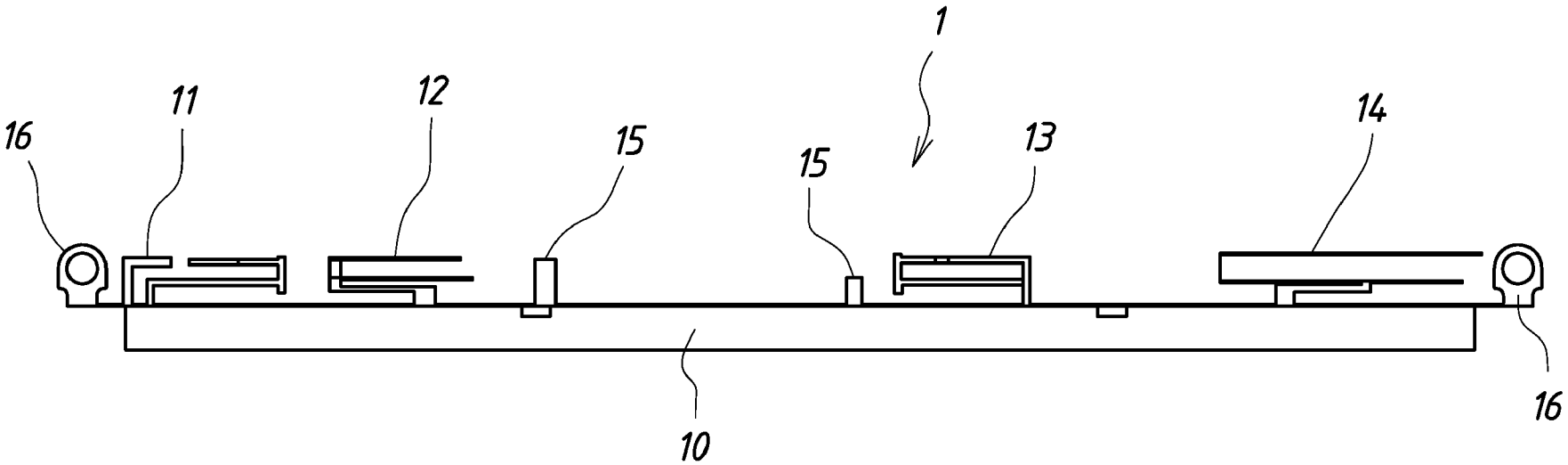
FIG. 2 is a plan view of the present invention.

Referring to FIGS. 1 and 2, an antenna structure 1 of the present invention comprises an elongate supporting rack 10 having thereon a first radiation member 11, a second radiation member 12, a third radiation member 13 and a fourth radiation member 14; the radiation members 11-14 are all planar, and are integrally connected with the supporting rack 10.

Figure 3:
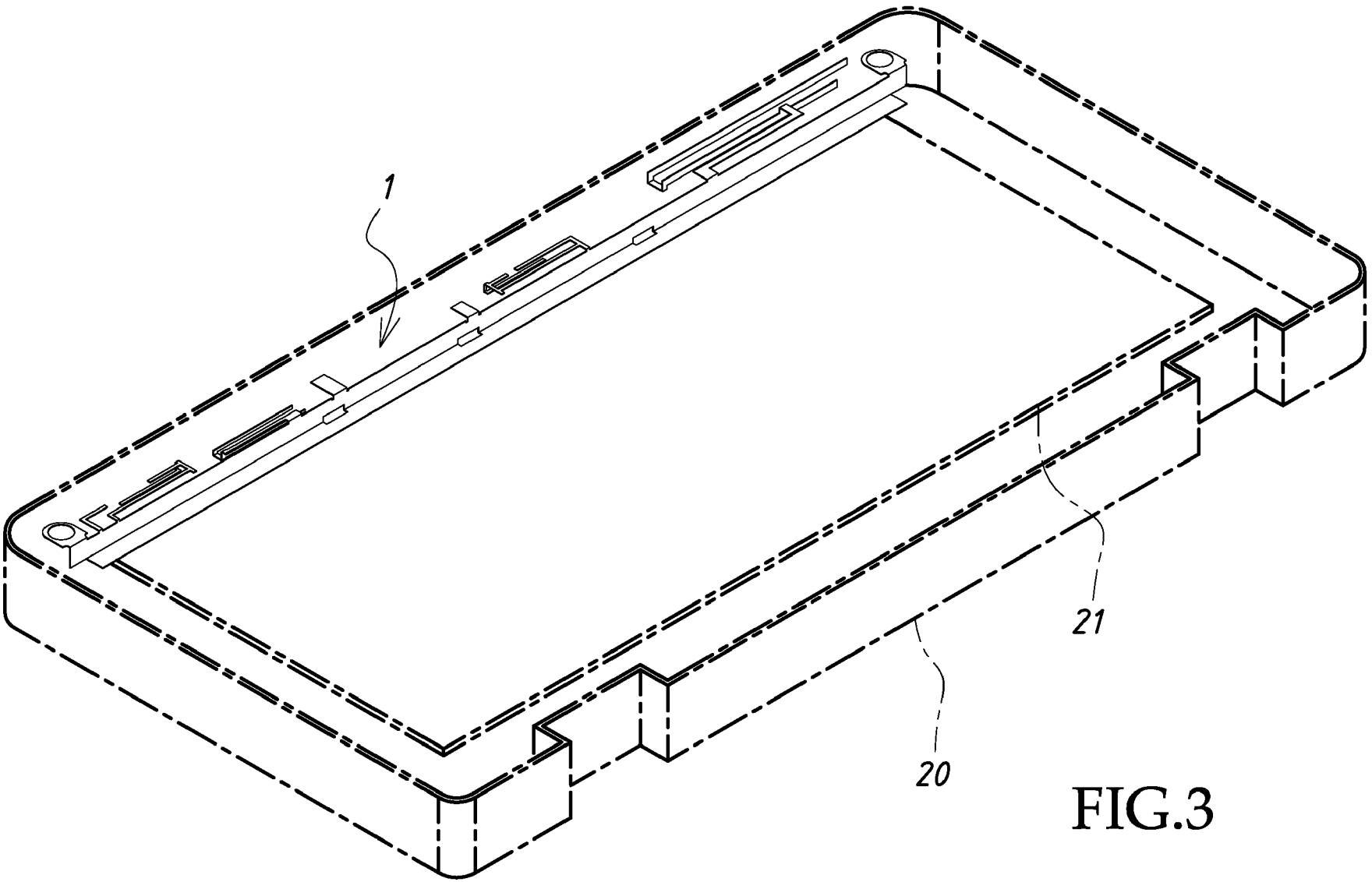
FIG. 3 is schematic view showing use of the present invention on a notebook.

A plurality of fixing hooks 15 are extended out of the supporting rack 10 which has two screw fixing holes 16 provided on the two mutually opposite ends thereof for locking in of screws for the convenience of mounting the supporting rack 10 above a displaying screen 21 of a notebook 20, as is shown in FIG. 3.

Figure 4:
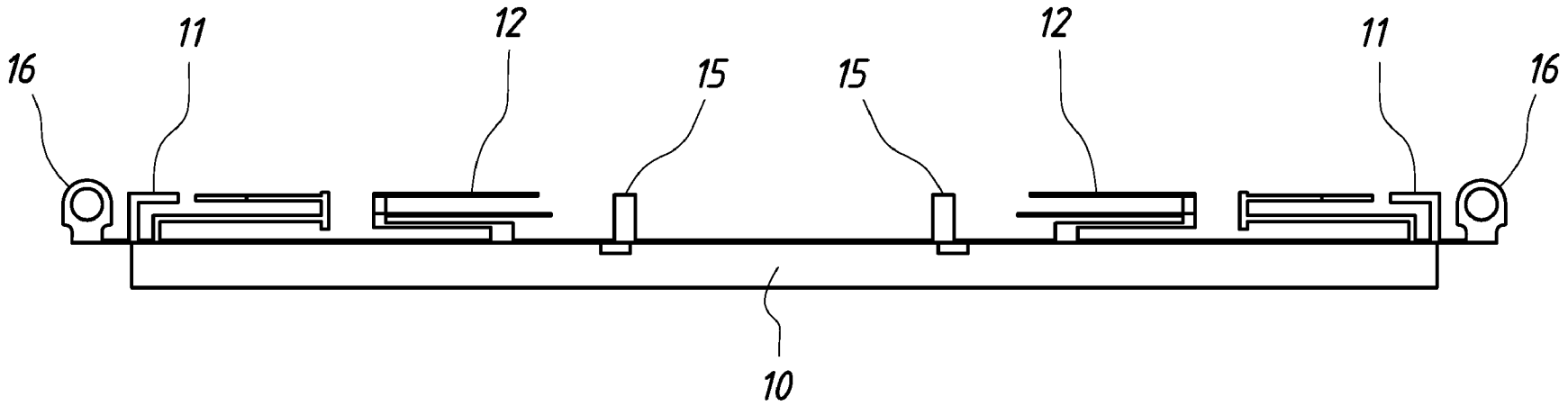
FIG. 4 is a plan view of another embodiment of the present invention.

In this embodiment, the first to the fourth radiation members 11-14 are of different working frequencies. FIG. 4 shows another embodiment of the present invention, wherein the first and the fourth radiation members 11, 14 are of same working frequency such as WIFI; and the second and the third radiation members 12, 13 are also of same working frequency such as GSM and WCDMA.

The fourth radiation members 11-14 of the present invention are integrally connected with the supporting rack 10, and a multi-frequency antenna structure can be made just with a set of mold, this can have an effect of saving space as in comparison of the present invention with the mode of having four radiation members formed and mounted separately, and can meet the tendency of compacting of notebooks. Moreover, it is capable to mount the multi-frequency antenna structure at one time; and this can make saving of time of processing in comparison with the mode of forming and mounting separately.

Having now particularly described and ascertained the novelty and improvement of my invention and in what manner the same is to be performed, what we claim will be declared in the claims followed.

The invention claimed is:

1. An antenna structure for a notebook with multiple radiation members, the antenna structure comprising:

an elongate supporting rack; and a first radiation member, a second radiation member, a third radiation member and a fourth radiation member;

wherein each radiation member of the first radiation member, the second radiation member, the third radiation member and the fourth radiation member is planar;

wherein the first radiation member, the second radiation member, the third radiation member and the fourth radiation member are spaced apart along a length of the supporting rack; and wherein each radiation member of the first radiation member, the second radiation member, the third radiation member and the fourth radiation member is directly connected to the supporting rack.

2. The antenna structure for a notebook according to claim 1, wherein at least two radiation members of a group consisting of the first radiation member, the second radiation member, the third radiation member and the fourth radiation member have a same working frequency.

3. The antenna structure for a notebook according to claim 1, wherein the first radiation member and the fourth radiation member have a same first working frequency, and the second radiation member and the third radiation member have a same second working frequency.

4. The antenna structure for a notebook according to claim 1, wherein the first radiation member, the second radiation member, the third radiation member and the fourth radiation member are integrally formed with the supporting rack.

5. The antenna structure for a notebook according to claim 1, wherein the supporting rack has a plurality of fixing hooks and two screw fixing holes, the plurality of fixing hooks extend outwardly from a middle portion of the supporting rack, one of the two screw fixing holes is located on each of two opposing ends of the supporting rack for mounting the supporting rack above a displaying screen of the notebook.

6. The antenna structure for a notebook according to claim 5, wherein the plurality of fixing hooks are located between the second radiation member and the third radiation member, the first radiation member is located between a first screw fixing hole of the two screw fixing holes and the second radiation member, and the fourth radiation member is located between a second screw fixing hole of the two screw fixing holes and the third radiation member.

* * * * *